US005971513A

United States Patent [19]

Cassalia

[11] Patent Number: 5,971,513

[45] Date of Patent: Oct. 26, 1999

[54] EASY LOAD EXTENDABLE/RETRACTABLE BOTTOM DISHWASHER RACK

[76] Inventor: Alan B. Cassalia, 315 Holly Hill Rd., Richboro, Pa. 18954

[21] Appl. No.: 09/044,309

[22] Filed: Mar. 19, 1998

[51] Int. Cl.[6] ..... A47B 88/00

[52] U.S. Cl. ..... 312/310; 312/272

[58] Field of Search ..... 312/310, 311, 312/228, 228.1, 272, 319.5, 319.8, 327; 211/41.8, 41.9

[56] References Cited

U.S. PATENT DOCUMENTS

| | | | |
|---|---|---|---|
| 2,769,678 | 11/1956 | Wolters | 312/310 |
| 2,808,310 | 10/1957 | Patterson, Jr. et al. | 312/310 X |
| 2,812,226 | 11/1957 | Wolters | 312/310 X |
| 3,431,040 | 3/1969 | Phelps et al. | 312/272 |
| 3,822,085 | 7/1974 | Clark | 312/311 X |
| 4,573,663 | 3/1986 | Nussbaum | 254/89 H |
| 5,595,200 | 1/1997 | Favaro | 312/310 X |
| 5,791,749 | 8/1998 | O'Neill et al. | 312/310 X |

*Primary Examiner*—Peter M. Cuomo
*Assistant Examiner*—James O. Hansen

[57] ABSTRACT

A new easy load extendable/retractable bottom dishwasher rack for raising to a height equal to that of a top rack. The inventive device includes a rack dimensioned for being received within a dishwasher. The rack is adapted for holding dishes and flatwares therein. The rack has a pair of upper tracks disposed on a lower surface thereof. A pair of lower tracks are provided with each having a pair of forward wheels and a pair of rearward wheels extending downwardly therefrom. The wheels are slidably received within opposed door tracks of a door of the dishwasher. A pair of scissor-action support assemblies extend between the pair of upper tracks and the pair of lower tracks. Lower ends of the support assemblies are coupled with the lower tracks. A forward lower end is pivotally coupled with the lower track. A rear lower end has a roller disposed thereon for being slidable within the lower tracks. Upper ends of the support assemblies are coupled with the upper tracks. The upper ends each have a pair of wheels coupled thereto with a space disposed between the wheels.

7 Claims, 7 Drawing Sheets

EASY LOAD EXTENDABLE/RETRACTABLE BOTTOM DISHWASHER RACK

BACKGROUND OF THE INVENTION

1. Field of the Invention

The present invention relates to dishwasher racks and more particularly pertains to a new easy load extendable/retractable bottom dishwasher rack for raising to a height equal to that of a top rack.

2. Description of the Prior Art

The use of dishwasher racks is known in the prior art. More specifically, dishwasher racks heretofore devised and utilized are known to consist basically of familiar, expected and obvious structural configurations, notwithstanding the myriad of designs encompassed by the crowded prior art which have been developed for the fulfillment of countless objectives and requirements.

Known prior art dishwasher racks include U.S. Pat. No. 3,982,802 to Bailey; U.S. Pat. No. 4,573,663 to Nussbaum; U.S. Pat. No. Des. 289,812 to Alvemarker; U.S. Pat. No. 5,205,419 to Purtilo; U.S. Pat. No. 5,211,189 to Santarossa; and U.S. Pat. No. 4,053,073 to Franchin.

While these devices fulfill their respective, particular objectives and requirements, the aforementioned patents do not disclose a new easy load extendable/retractabic bottom dishwasher rack. The inventive device includes a rack dimensioned for being received within a dishwasher. The rack is adapted for holding dishes and flatwares therein. The rack has a pair of upper tracks disposed on a lower surface thereof. A pair of lower tracks are provided with each having a pair of forward wheels and a pair of rearward wheels extending downwardly therefrom. The wheels are slidably received within opposed door tracks of a door of the dishwasher. A pair of scissor-action support assemblies extend between the pair of upper tracks and the pair of lower tracks. Lower ends of the support assemblies are coupled with the lower tracks. A forward lower end is pivotally coupled with the lower track. A rear lower end has a roller disposed thereon for being slidable within the lower tracks. Upper ends of the support assemblies are coupled with the upper tracks. The upper ends each have a pair of wheels coupled thereto with a space disposed between the wheels.

In these respects, the easy load extendable/retractable bottom dishwasher rack according to the present invention substantially departs from the conventional concepts and designs of the prior art, and in so doing provides an apparatus primarily developed for the purpose of raising to a height equal to that of a top rack.

SUMMARY OF THE INVENTION

In view of the foregoing disadvantages inherent in the known types of dishwasher racks now present in the prior art, the present invention provides a new easy load extendable/retractable bottom dishwasher rack construction wherein the same can be utilized for raising to a height equal to that of a top rack.

The general purpose of the present invention, which will be described subsequently in greater detail, is to provide a new easy load extendable/retractable bottom dishwasher rack apparatus and method which has many of the advantages of the dishwasher racks mentioned heretofore and many novel features that result in a new easy load extendable/retractable bottom dishwasher rack which is not anticipated, rendered obvious, suggested, or even implied by any of the prior art dishwasher racks, either alone or in any combination thereof.

To attain this, the present invention generally comprises a rack dimensioned for being received within a dishwasher. The rack is adapted for holding dishes and flatwares therein. The rack has a pair of upper tracks disposed on a lower surface thereof. A pair of lower tracks are provided with each having a pair of forward wheels and a pair of rearward wheels extending downwardly therefrom. The wheels are slidably received within opposed door tracks of a door of the dishwasher. A pair of scissor-action support assemblies extend between the pair of upper tracks and the pair of lower tracks. Lower ends of the support assemblies arc coupled with the lower tracks. A forward lower end is pivotally coupled with the lower track. A rear lower end has a roller disposed thereon for being slidable within the lower tracks. Upper ends of the support assemblies are coupled with the upper tracks. The upper ends each have a pair of wheels coupled thereto with a space disposed between the wheels. A pair of spring-loaded pistons are disposed within the pair of upper tracks. The pistons extend between the pair of wheels of the upper ends of the support assemblies. Free ends of the pistons are positioned within the space between the pair of wheels and coupling with an axle thereof. The pistons pull the pair of wheels of the upper ends together to raise the rack with respect to the lower tracks and the dishwasher door. A pair of locking members are pivotally coupled with forward ends of the lower tracks. The locking members engage the rack in a lowered orientation and release the rack in a raised orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new easy load extendable/retractable bottom dishwasher rack apparatus and method which has many of the advantages of the dishwasher racks mentioned heretofore and many novel features that result in a new easy load extendable/retractable bottom dishwasher rack which is not anticipated, rendered obvious, suggested, or even implied by any of the prior art dishwasher racks, either alone or in any combination thereof.

It is another object of the present invention to provide a new easy load extendable/retractable bottom dishwasher rack which may be easily and efficiently manufactured and marketed.

It is a further object of the present invention to provide a new easy load extendable/retractable bottom dishwasher rack which is of a durable and reliable construction.

An even further object of the present invention is to provide a new easy load extendable/retractable bottom dishwasher rack which is susceptible of a low cost of manufacture with regard to both materials and labor, and which accordingly is then susceptible of low prices of sale to the consuming public, thereby making such easy load extendable/retractable bottom dishwasher rack economically available to the buying public.

Still yet another object of the present invention is to provide a new easy load extendable/retragtable bottom dishwasher rack which provides in the apparatuses and methods of the prior art some of the advantages thereof, while simultaneously overcoming some of the disadvantages normally associated therewith.

Still another object of the present invention is to provide a new easy load extendable/retractable bottom dishwasher rack for raising to a height equal to that of a top rack.

Yet another object of the present invention is to provide a new easy load extendable/retractable bottom dishwasher rack which includes a rack dimensioned for being received within a dishwasher. The rack is adapted for holding dishes and flatwares therein. The rack has a pair of upper tracks disposed on a lower surface thereof. A pair of lower tracks are provided with each having a pair of forward wheels and a pair of rearward wheels extending downwardly therefrom. The wheels are slidably received within opposed door tracks of a door of the dishwasher. A pair of scissor-action support assemblies extend between the pair of upper tracks and the pair of lower tracks. Lower ends of the support assemblies are coupled with the lower tracks. A forward lower end is pivotally coupled with the lower track. A rear lower end has a roller disposed thereon for being slidable within the lower tracks. Upper ends of the support assemblies are coupled with the upper tracks. The upper ends each have a pair of wheels coupled thereto with a space disposed between the wheels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
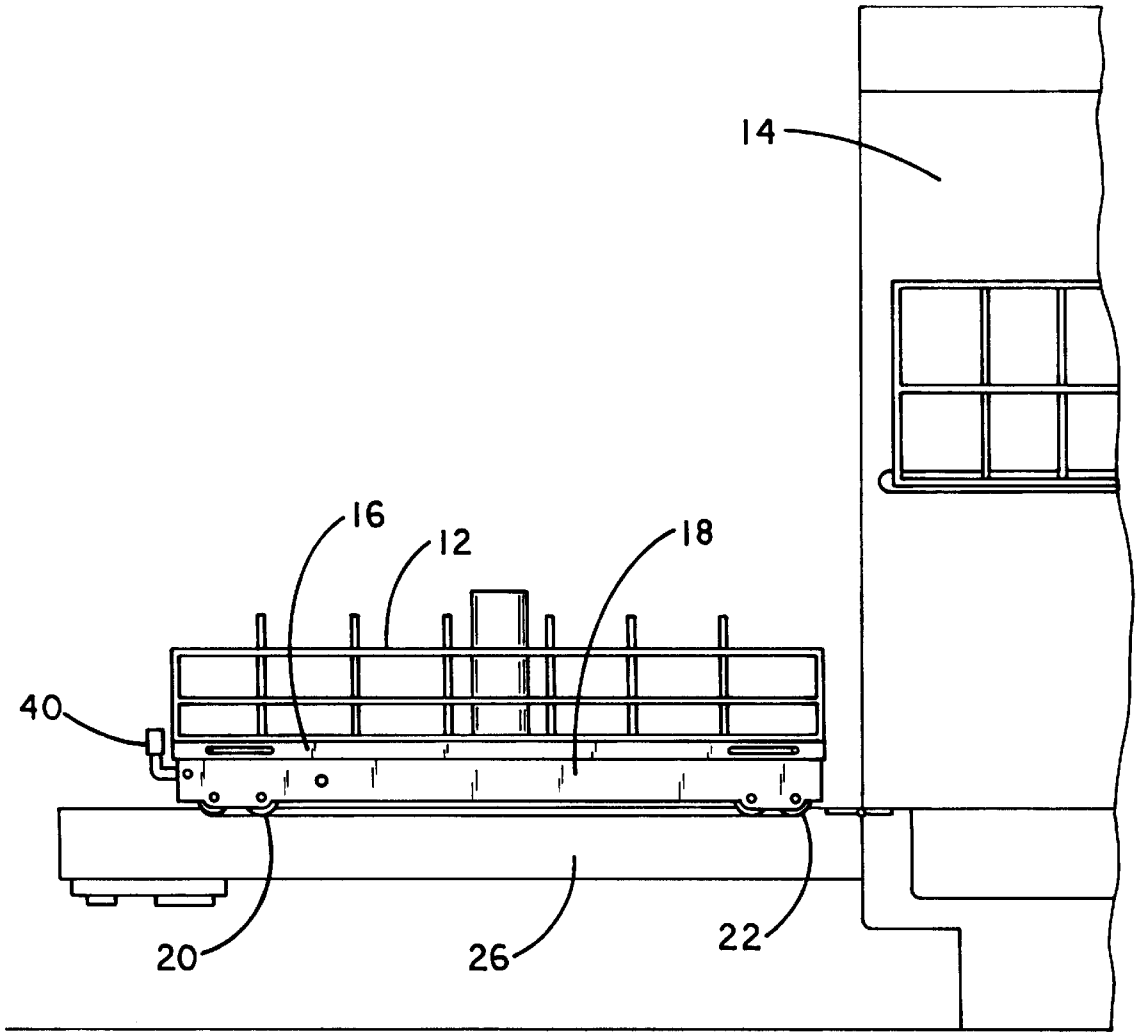
FIG. 1 is a side view of a new easy load extendable/retractable bottom dishwasher rack according to the present invention illustrated in lower orientation.
Figure 2:
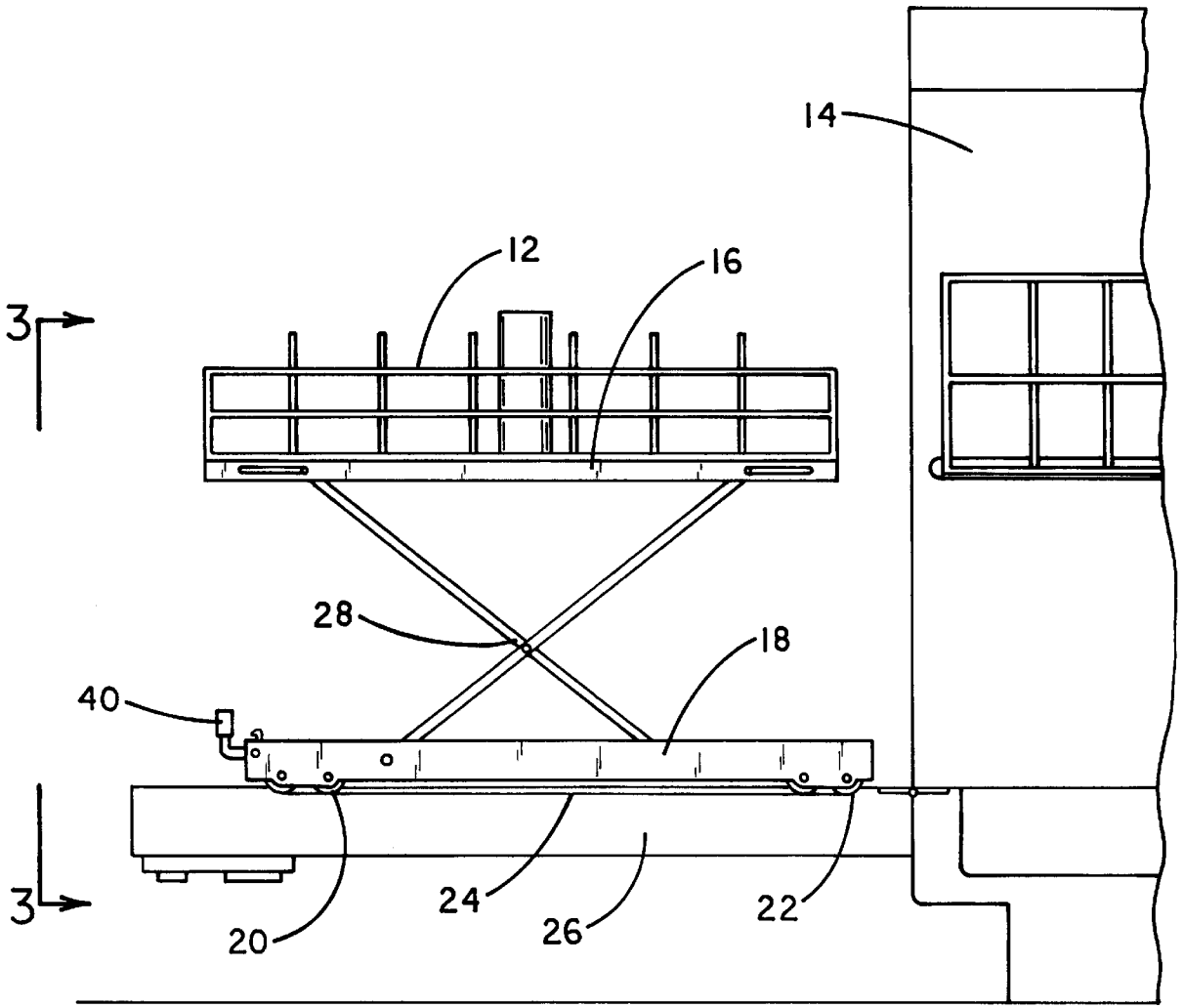
FIG. 2 is a side view of the present invention illustrated in a raised orientation.
Figure 3:
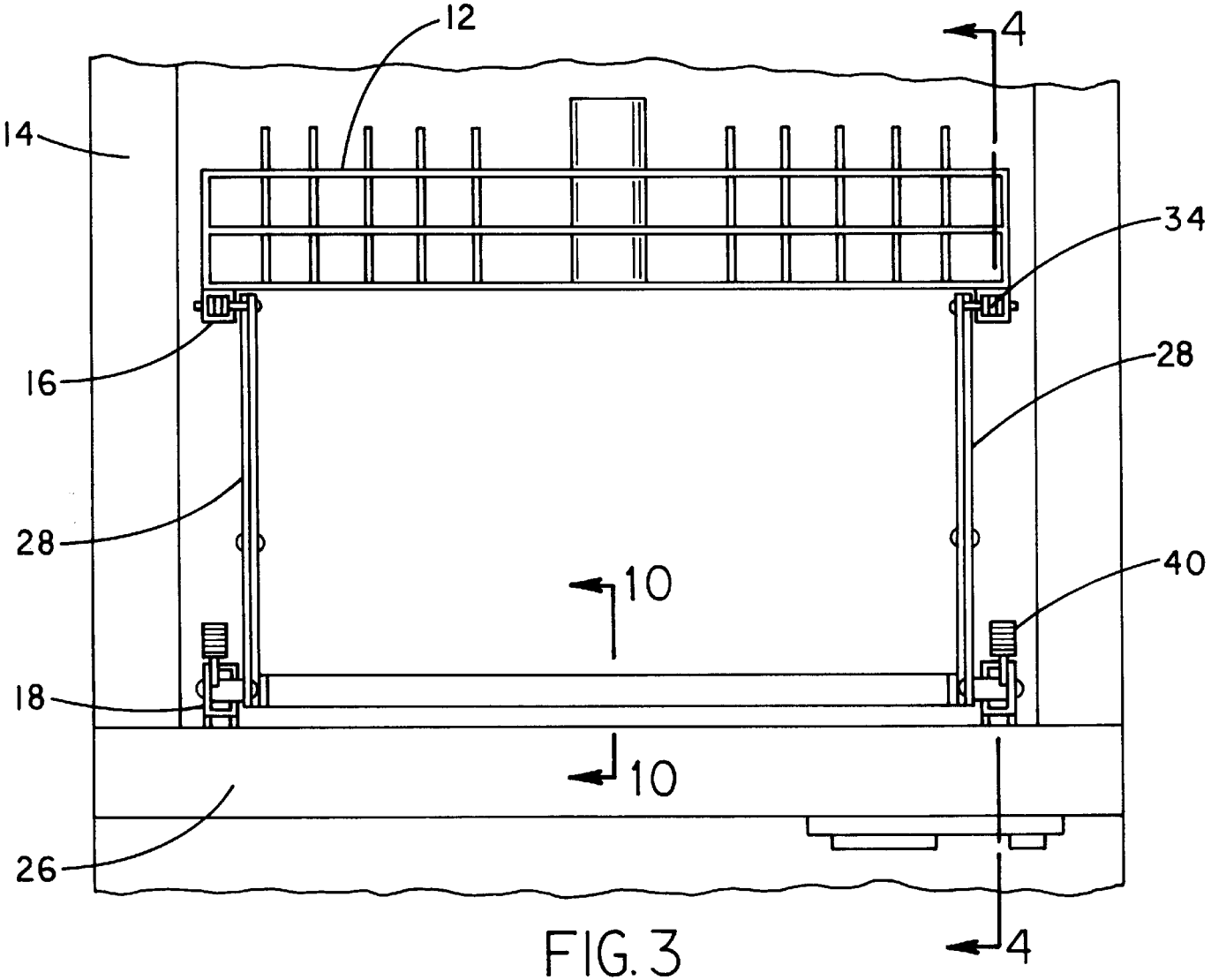
FIG. 3 is a front view of the present invention as taken along line 3—3 of FIG. 2.
Figure 4:
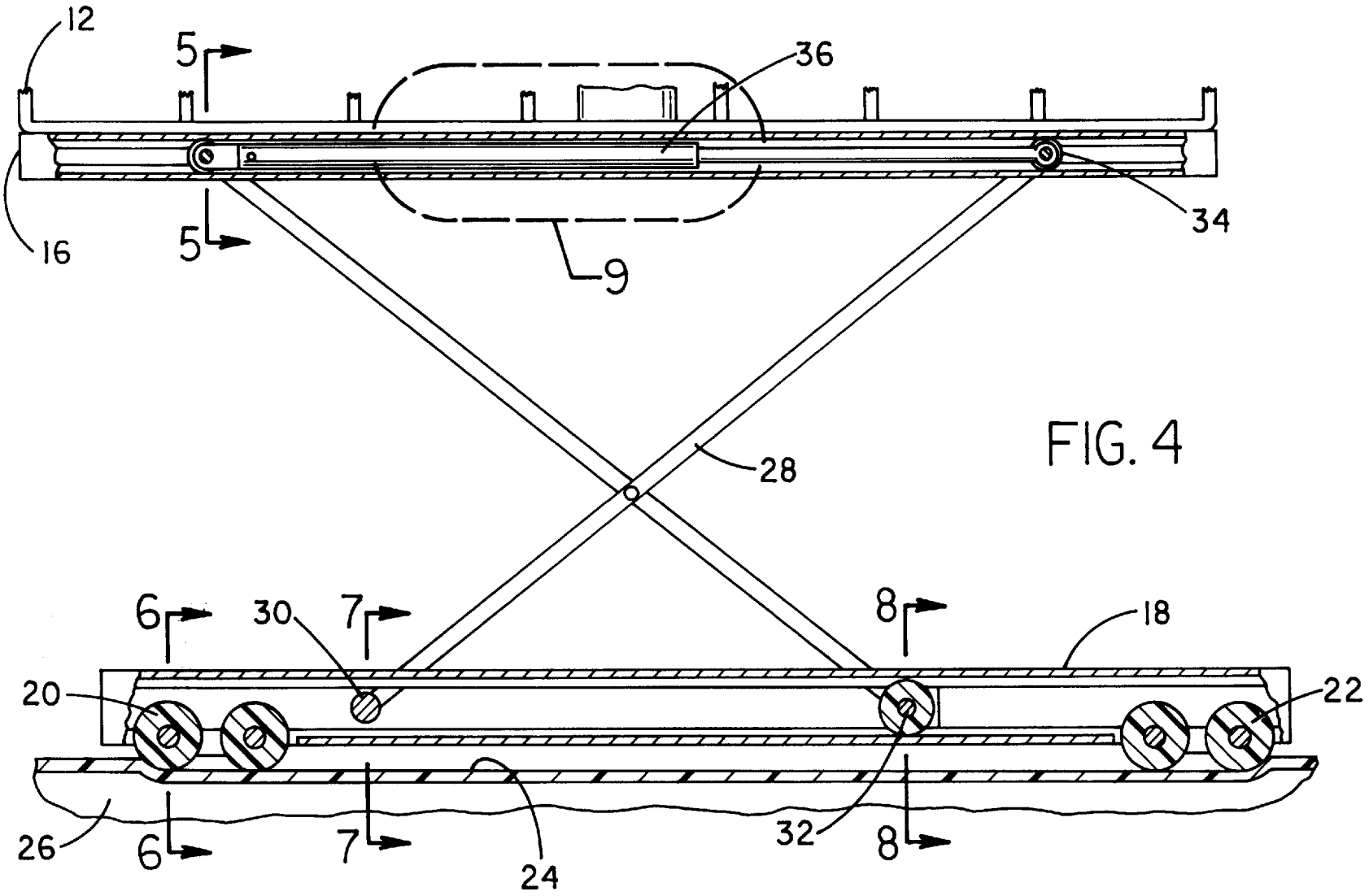
FIG. 4 is a cross-sectional view of the present invention as taken along line 4—4 of FIG. 3.
Figure 5:
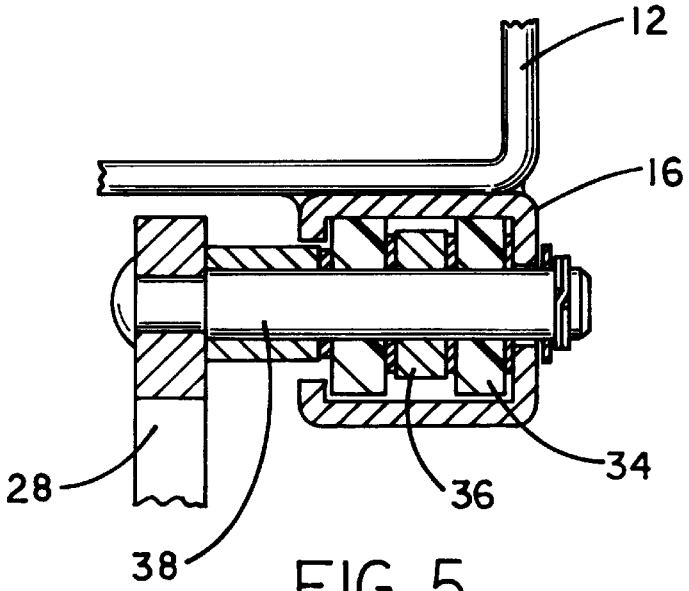
FIG. 5 is a cross-sectional view of the present invention as taken along line 5—5 of FIG. 4.
Figure 7:
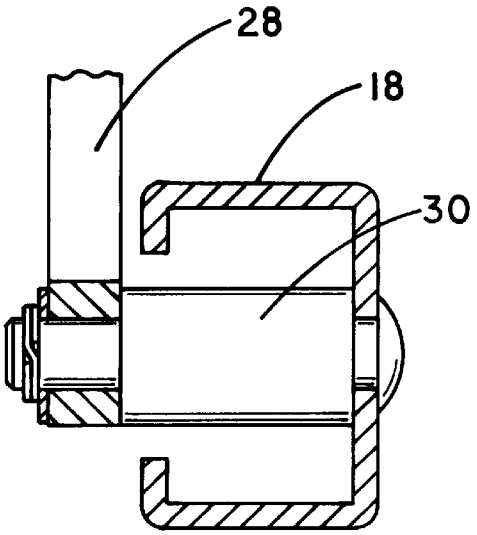
FIG. 7 is a cross-sectional view of the present invention as taken long line 7—7 of FIG. 4.
Figure 6:
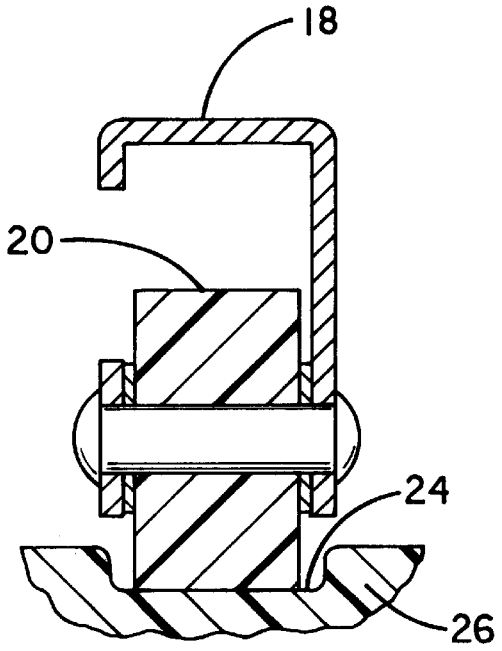
FIG. 6 is a cross-sectional view of the present invention as taken along line 6—6 of FIG. 4.
Figure 8:
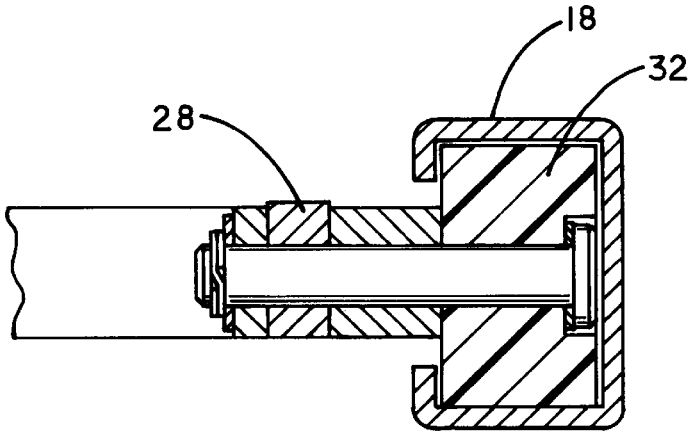
FIG. 8 is a cross-sectional view of the present invention as taken along line 8—8 of FIG. 4.
Figure 9:
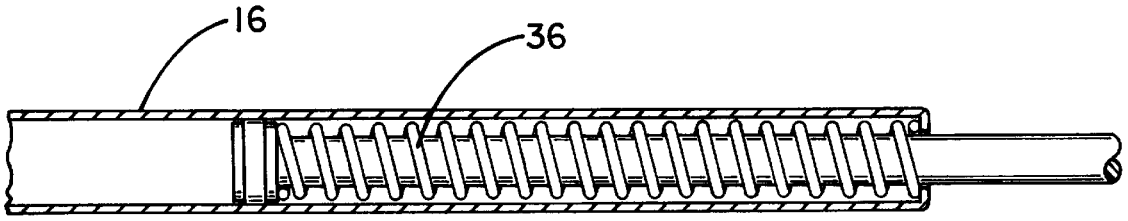
FIG. 9 is a side sectional view of the spring loaded piston of the present invention as taken from circle 9 of FIG. 4.
Figure 10:
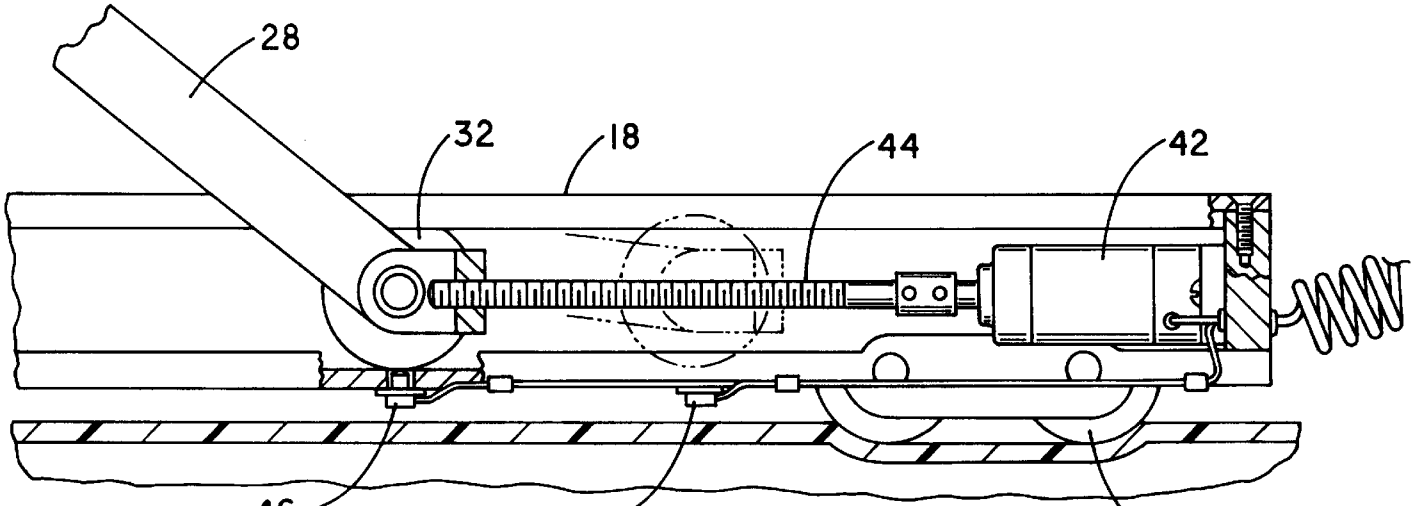
FIG. 10 is a side view of an alternate embodiment of the present invention.
Figure 11:
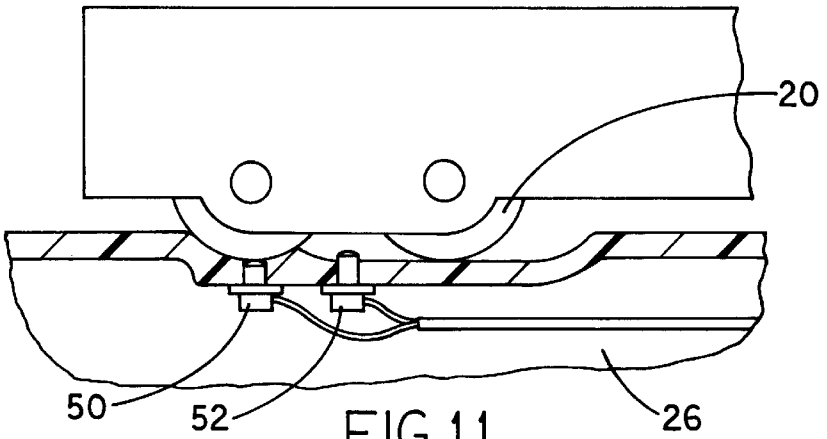
FIG. 11 is a side view of the alternate embodiment of the present invention.

With reference now to the drawings, and in particular to FIGS. 1 through 11 thereof, a new easy load extendable/retractable bottom dishwasher rack embodying the principles and concepts of the present invention and generally designated by the reference numeral 10 will be described.

As best illustrated in FIGS. 1 through 11, the easy load extendable/retractable bottom dishwasher rack 10 comprises a rack 12 dimensioned for being received within a dishwasher 14. The rack 12 is adapted for holding dishes and flatwares therein. The rack 12 has a pair of upper tracks 16 disposed on a lower surface thereof.

A pair of lower tracks 18 are provided with each having a pair of forward wheels 20 and a pair of rearward wheels 22 extending downwardly therefrom. The wheels 20,22 are slidably received within opposed door tracks 24 of a door 26 of the dishwasher 14.

A pair of scissor-action support assemblies 28 extend between the pair of upper tracks 16 and the pair of lower tracks 18. Lower ends of the support assemblies 28 are coupled with the lower tracks 18. A forward lower end 30 is pivotally coupled with the lower track 18. A rear lower end has a roller 32 disposed thereon for being slidable within the lower tracks 18. Upper ends of the support assemblies 28 are coupled with the upper tracks 16. The upper ends each have a pair of wheels 34 coupled thereto with a space disposed between the wheels 34.

A pair of spring-loaded pistons 36 are disposed within the pair of upper tracks 16. The pistons 36 extend between the pair of wheels 34 of the upper ends of the support assemblies 28. Free ends of the pistons 36 are positioned within the space between the pair of wheels 34 and coupling with an axle 38 thereof. The pistons 36 pull the pair of wheels 34 of the upper ends together to raise the rack 12 with respect to the lower tracks 18 and the dishwasher door 26.

A pair of locking members 40 are pivotally coupled with forward ends of the lower tracks 18. The locking members 40 engage the rack 12 in a lowered orientation and release the rack 12 in a raised orientation.

Alternate means for raising and the lowering of the rack could be included in the present invention. Note FIGS. 10 and 11. A pair of motors 42 are disposed within the lower tracks 18. Each of the motors 42 have a threaded rod 44 extending forwardly therefrom for engaging the rollers 32 of the support assemblies 28. A pair of stop switches are in communication with the motor 42. The pair of stop switches include a first stop switch 46 for stopping the motor 42 at the raised orientation and a second stop switch 48 for stopping the motor 42 in the lowered orientation whereby the switches will be contacted by the rollers 32. A pair of activation switches are disposed within the lower tracks 18 for being contacted by the pair of forward wheels 20. The activation switches are in communication with the motors 42. The activation switches include a first activation switch 50 for lifting the rack 12 and a second activation switch 52 for lowering the rack 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and dcscribed, and accordingly, all suitable modifications and equivalents m ay be resorted to, falling within the scope of the invention.

I claim:

1. A new easy load extendable/retractable bottom dishwasher rack for raising to a height equal to that of a top rack comprising, in combination:

a rack dimensioned for being received within a dishwasher, the rack being adapted for holding dishes and flatwares therein, the rack having a pair of upper tracks disposed on a lower surface thereof;

a pair of lower tracks each having a pair of forward wheels and a pair of rearward wheels extending downwardly therefrom, the wheels being slidably received within opposed door tracks of a door of the dishwasher;

a pair of scissor-action support assemblies extending between the pair of upper tracks and the pair of lower tracks, lower ends of the support assemblies coupled with the lower tracks, a forward lower end being pivotally coupled with the lower track, a rear lower end having a roller disposed thereon for being slidable within the lower tracks, upper ends of the support assemblies coupled with the upper tracks, the upper ends each having a pair of wheels coupled thereto with a space disposed between the wheels;

a pair of spring-loaded pistons disposed within the pair of upper tracks, the pistons extending between the pair of wheels of the upper ends of the support assemblies, free ends of the pistons positioned within the space between the pair of wheels and coupling with an axle thereof, the pistons pulling the pair of wheels of the upper ends together to raise the rack with respect to the lower tracks and the dishwasher door; and a pair of locking members pivotally coupled with forward ends of the lower tracks, the locking members engaging the rack in a lowered orientation and releasing the rack in a raised orientation.

2. A new easy load extendable/retractable bottom dishwasher rack for raising to a height equal to that of a top rack comprising, in combination:

a rack dimensioned for being received within a dishwasher, the rack being adapted for holding dishes and flatwares therein, the rack having a pair of upper tracks disposed on a lower surface thereof;

a pair of lower tracks each having a pair of forward wheels and a pair of rearward wheels extending downwardly therefrom, the wheels being slidably received within opposed door tracks of a door of the dishwasher;

a pair of scissor-action support assemblies extending between the pair of upper tracks and the pair of lower tracks, lower ends of the support assemblies coupled with the lower tracks, a forward lower end being pivotally coupled with the lower track, a rear lower end having a roller disposed thereon for being slidable within the lower tracks, upper ends of the support assemblies coupled with the upper tracks, the upper ends each having a pair of wheels coupled thereto with a space disposed between the wheels; and means for selectively raising and lowering the rack with respect to the lower tracks and the dishwasher door.

3. The easy load extendable/retractable bottom dishwasher rack as set forth in claim 2 wherein the means for raising and the lowering of the rack is comprised of a pair of spring-loaded pistons disposed within the pair of upper tracks, the pistons extending between the pair of wheels of the upper ends of the support assemblies, free ends of the pistons positioned within the space between the pair of wheels and coupling with an axle thereof, the pistons pulling the pair of wheels of the upper ends together to raise the rack with respect to the lower tracks and the dishwasher door.

4. The easy load extendable/retractable bottom dishwasher rack as set forth in claim 2 and further including a pair of locking members pivotally coupled with forward ends of the lower tracks, the locking members engaging the rack in a lowered orientation and releasing the rack in a raised orientation.

5. The easy load extendable/retractable bottom dishwasher rack as set forth in claim 2 wherein the means for raising and the lowering of the rack is comprised of a pair of motors disposed within the lower tracks, each of the motors having a threaded rod extending forwardly therefrom for engaging the rollers of the support assemblies.

6. The easy load extendable/retractable bottom dishwasher rack as set forth in claim 5 and further including a pair of stop switches in communication with the motor, the pair of stop switches including a first stop switch for stopping the motor at the raised orientation and a second stop switch for stopping the motor in the lowered orientation whereby the switches will be contacted by the rollers.

7. The easy load extendable/retractable bottom dishwasher rack as set forth in claim 6 and further including a pair of activation switches disposed within the lower tracks for being contacted by the pair of forward wheels, the activation switches being in communication with the motors, the activation switches including a first activation switch for lifting the rack and a second activation switch for lowering the rack.

* * * * *